United States Patent [19]

Katz

[11] Patent Number: 4,969,655

[45] Date of Patent: Nov. 13, 1990

[54] SNOW BOARD

[75] Inventor: Robert Katz, Montreal, Canada

[73] Assignee: St-Lawrence Manufacturing Canada./Manufactures St-Laurent Canada, Inc., Beauport, Canada

[21] Appl. No.: 263,016

[22] Filed: Oct. 27, 1988

[51] Int. Cl.[5] ..... A63C 5/03

[52] U.S. Cl. ..... 280/14.2; 280/607; 280/11.3; 280/610; 441/74

[58] Field of Search ..... 280/14.2, 14.3, 18, 280/19, 845, 28, 21, 610, 607, 609, 602, 11.3, 619, 620; 441/68, 70, 74, 75

[56] References Cited

U.S. PATENT DOCUMENTS 4,028,761 6/1977 Taylor ..... 280/18

FOREIGN PATENT DOCUMENTS 167195 4/1950 Austria ..... 280/600
0115297 8/1984 European Pat. Off. ..... 280/18
3046956 7/1982 Fed. Rep. of Germany ..... 441/74
3323813 1/1985 Fed. Rep. of Germany ..... 280/14.2
3628623 3/1988 Fed. Rep. of Germany ..... 280/14.2
3702094 8/1988 Fed. Rep. of Germany ..... 280/14.2

*Primary Examiner*—David M. Mitchell
*Attorney, Agent, or Firm*—Samuel Meerkreebs

[57] ABSTRACT

In a board for snow skiing comprising an elongated blow-molded plastic ski body. The body includes a top and a bottom wall and reinforcements extending therebetween. First and second spaced apart bindings are mounted to the board for respectively receiving a front and a rear foot of a rider of the board. The bindings each comprise a pair of flexible plastic bands which are fixedly mounted at a first end part thereof to the board in a spaced and substantially parallel relationship. The bands also include at a second end part thereof a cooperating fastening device. Each binding also comprises a strap having each of two ends thereof attached to one of the bands for securing a back part of the foot of the rider to the binding.

17 Claims, 4 Drawing Sheets

SNOW BOARD

BACKGROUND OF INVENTION

Field of the Invention

This invention relates to a ski board and, more particularly, to a board for snow skiing. Prior Art Presently, snow boards come in different shapes, are of different construction and are provided with different types of bindings.

Injection molding is used for making the basic plastic snow board. Some snow boards are adapted with bindings designed for receiving standard ski boots. Others offer a binding adapted for receiving a general footwear and, more particularly, a winter boot which overlies a base plate of the binding. The binding and the base plate can also be adapted for swiveling with respect to the snow board.

The above mentioned types of bindings are substantially expensive.

SUMMARY OF INVENTION

It is therefore an aim of the present invention to provide a snow board having a low cost binding.

It is also an aim of the present invention to provide a snow board that is produced by blow-molding.

It is still a further aim of the present invention to provide a snow board having reinforcement recesses or grooves defined on a bottom surface thereof.

A construction in accordance with the present invention comprises a board for snow skiing having an elongated blow-molded plastic ski body. The body includes a top and a bottom wall and reinforcing means extending between the top and bottom walls. A first and a second spaced apart binding means are mounted to the board for respectively receiving a front and a rear foot of a rider of the board.

Another construction in accordance with the present invention comprises a board for snow skiing having an elongated ski body. The body includes a top and a bottom wall and reinforcing means extending therebetween. A first and a second spaced apart binding means are mounted to the body for respectively receiving a front and a rear foot of a rider of the board. The binding means each comprises a pair of flexible plastic bands fixedly mounted at a first end part thereof to the board in a spaced and substantially parallel relationship. The bands include at a second end part thereof cooperating fastening means. Each binding means also comprises a strap means having each of two ends thereof attached to one of the bands for securing a back part of the foot to the binding means.

BRIEF DESCRIPTION OF DRAWINGS

Having thus generally described the nature of the invention, reference will now be made to the accompanying drawings, showing by way of illustration a preferred embodiment thereof, and in which.

DESCRIPTION OF PREFERRED EMBODIMENTS

Figure 1:
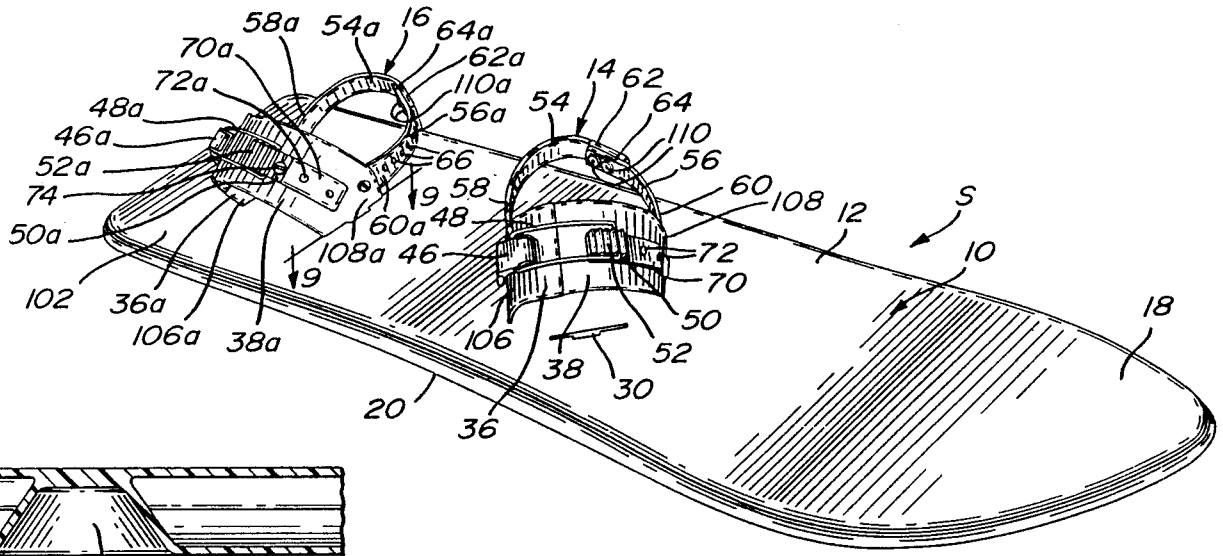
FIG. 1 is a perspective view of a snow board according to the present invention.
Figure 6:
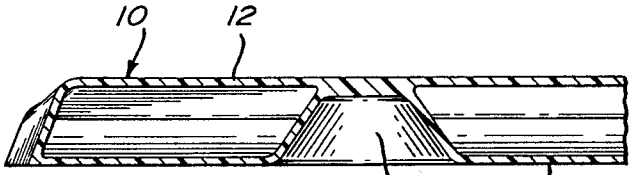
FIG. 6 is a cross-sectional elevation view taken along line 6—6 of FIG. 3 illustrating a tapered recess defined on a lower surface of the snow board.

A snow board S has a blow-molded plastic body 10 of substantially conventional shape.

A top wall 12 of the body 10 is provided with first and second bindings 14 and 16 respectively. A detailed description of the bindings 14 and 16 and the relationship thereof with the body 10 will be given hereinbelow.

The tip 18 of the body 10 is slightly curved upwardly to imitate a snow ski and, more particularly a water ski or a surfing board. Similarly, a middle part 20 of the body 10 is curved.

Figure 3:
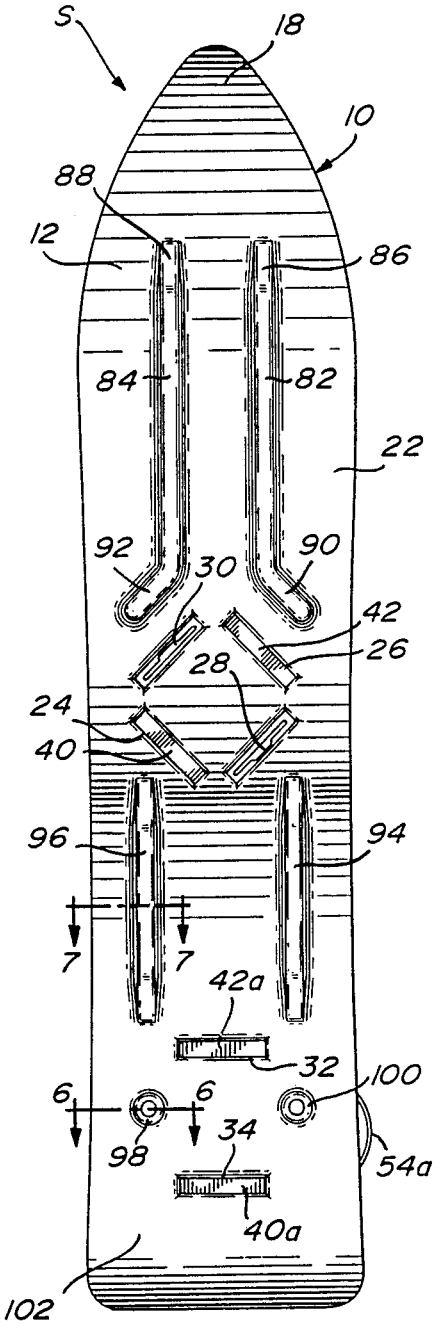
FIG. 3 is a bottom plan view of the snow board.

Now referring to FIG. 3, a bottom wall 22 of the body 10 is provided with first, second, third, fourth, fifth and sixth slots which are defined therethrough and are numbered 24, 26, 28, 30, 32 and 34 respectively. Slots 28 and 30 are clearly seen in FIG. 3, as slots 24, 26, 32 and 34 are obscured by lower parts of the bindings 14 and 16 which are to be described later. The first binding 14 can be positioned either into the slots 24 and 26 as it is represented on the drawings, or into slots 28 and 30. In the first case, the left foot of the rider is secured into the first binding 14 and the right foot thereof into the second binding 16, whereas slots 28 and 30 are used for positioning the right foot of the rider into the first binding 14. The slots 24, 26, 28 and 30 are defined substantially at a 45° angle with respect to the longitudinal axis of the body 10 of the snow board S, whereby the front foot of the rider is at the same angle relative to this longitudinal axis. The slots 32 and 34 are defined transversely with respect to the body 10 for positioning the rear foot of the rider substantially perpendicularly to the longitudinal axis of the snow board S.

Both the first and the second bindings 14 and 16 being constructed in a same fashion, only the first binding 14 will now be described. Corresponding parts of both bindings 14 and 16 will have the same number, the suffix "a" being added to the numbers associated with the second binding 16.

The binding 14 comprises first and second elongated plastic bands 36 and 38 respectively. Both bands 36 and 38 are mounted at lower ends thereof 40 and 42 respectively in the slots 24 and 26 of the body 10 in a way that will be described later. The bands 36 and 38 act as a strap for surrounding part of the front foot of the rider and, more particularly, overlying the front top and sides of the footwear. A first metal plate 44, fixedly mounted by way of nuts and bolts (not shown) to the first band 36, comprises a pivoting buckle 46 provided with a wire loop 48.

A second metal plate 50, fixedly mounted to the second band 38 in a similar way, includes a series of inclined metal transverse recesses 52 adapted for receiving the wire loop 48. By placing the wire loop 48 in the proper recess 52 and by pivoting the buckle 46 away therefrom, the bands 36 and 38 overlap enough for ensuring tightness of the foot therein.

Figure 8:
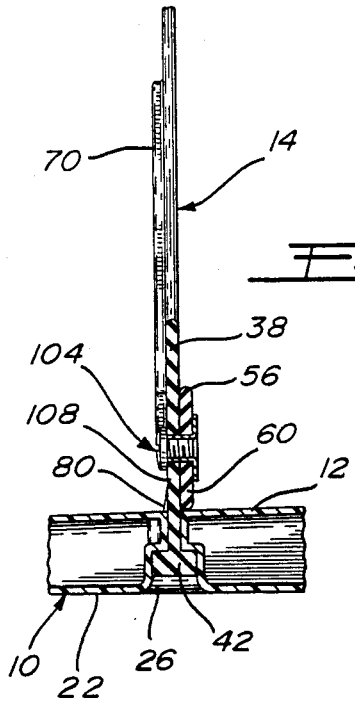
FIG. 8 is a cross-sectional elevation view taken along line 8—8 of FIG. 2 illustrating binding parts secured together.
Figure 9:
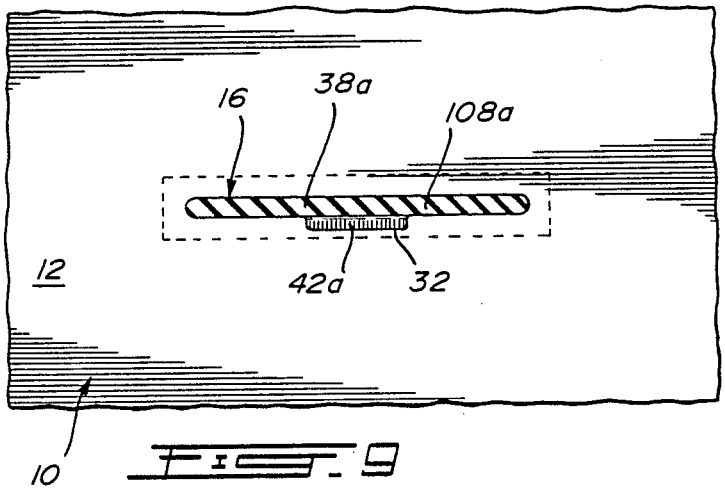
FIG. 9 is a cross-sectional top plan view taken along line 9—9 of FIG. 1 showing the part of the binding mounted to the snow board.

A pair cf elongated straps 54 and 56 are respectively fixed at first ends 58 and 60 thereof respectively to lower parts 106 and 108 of respective bands 36 and 38 adjacent the top wall 12 of the body 10 by way of a nut and bolt arrangement which is typically illustrated in FIG. 8 as 104. Respective second ends 62 and 64 of the straps 54 and 56 are joined together bY nuts and bolts 110. The straps 54 and 56 are provided with a longitudinal series of holes defined therein for allowing proper adjustment thereof on a back portion of the footwear. Such holes are shown as 66 on the strap **56*a* in FIG. 1**.

The bands 36 and 38 are provided with slight plastic elevations 68 and 70 which are integral thereto and on which are respectively mounted the plate 44 holding the buckle 46 and the plate 50 including the recesses 52. Similarly, the plates **36*a* and 38*a* are provided with respective elevations 68*a* and 70*a*. Such elevations are best seen in FIGS. 1, 2, 4, 5 and 8**.

Holes 72 are defined through the elevation 70 and corresponding underlying section of the band 38 for allowing respective adjustment of the plate 50, a bolt and nut arrangement 74 being used therefor which is typically shown as 74 in FIG. 1 for the plate **50*a* of the band 38*a***.

Figure 4:
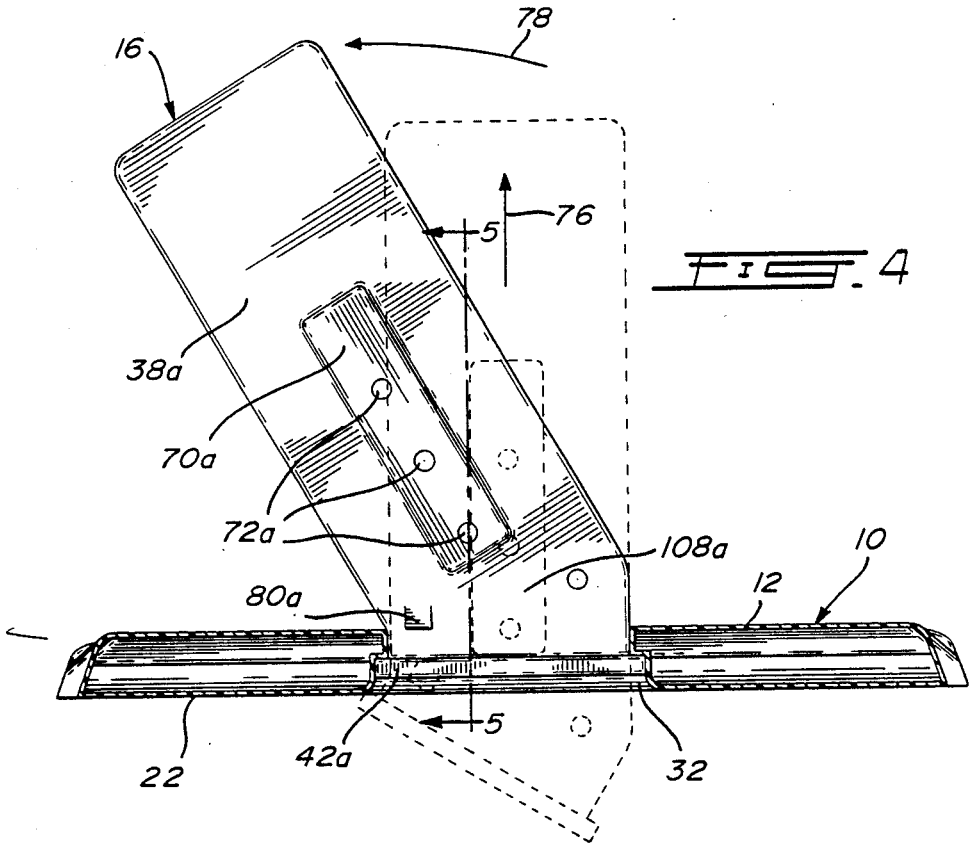
FIG. 4 is a side view partly in cross-section taken along line 4—4 of FIG. 2 showing in full lines part of a binding which is mounted to the snow board, and, in broken lines, a releasing position thereof with respect to the snow board.
Figure 5:
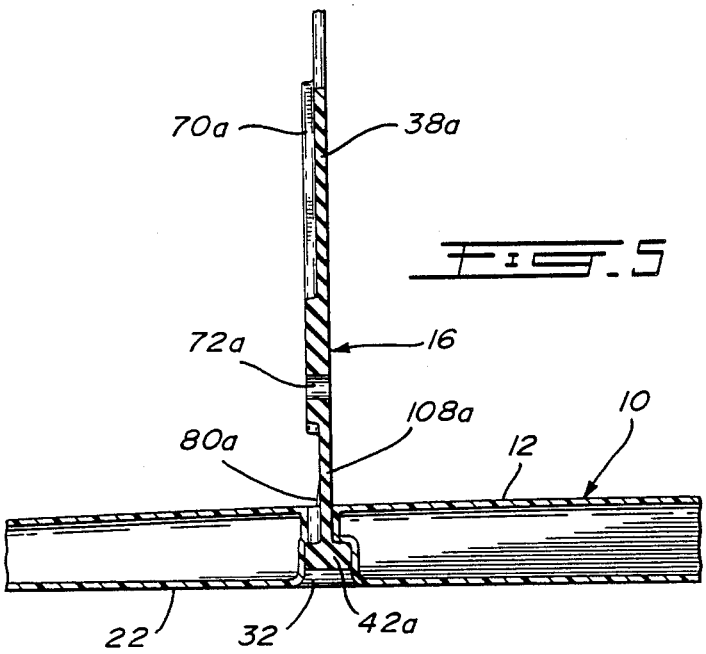
FIG. 5 is a cross-sectional elevation view taken along line 5—5 of FIG. 4 showing the part of the binding of FIG. 4 mounted to the snow board.

The bands 36, **36*a*, 38 and 38*a* are all mounted to the body 10 of the snow board S in a same way. FIG. 4 illustrates how the band 38*a* is mounted to the body 10. The band 38*a* is upwardly slid in the groove 32 as shown by the vertical arrow 76 and then pivoted in the direction of the arrow 78. The bottom part 42*a* of the band 38*a* is enlarged for engagement thereof in the groove 32 as best seen in FIG. 5. This prevents any upward displacement of the band 38*a* relative to the body 10. The downward motion of each of the bands 36, 36*a*, 38 and 38*a* is prevented by slight tapered protrusions provided near the respective lower parts 106, 106*a*, 108 and 108*a* of these bands. Such tapered protrusions are shown as 80 and 80*a* respectively for the bands 38 and 38*a* as can be seen in FIGS. 4, 5 and 8. A downward movement of the bands 36, 36*a*, 38 and 38*a* is further prevented by the attachment thereto of the first ends 58, 58*a*, 60 and 60*a* of the straps 54, 54*a*, 56 and 56*a*, as best seen in FIG. 8 wherein the first end 60 of the strap 56 is mounted to lower part 108 of the band 38 and contacts the upper wall 12 of the body 10 for preventing a downward displacement of the band 38 with respect to the body 10**.

Now referring to FIG. 3, the bottom wall 22 of the body 10 is provided with a series of reinforcement grooves and recesses which extend between the top and bottom walls 12 and 22. A first pair of grooves 82 and 84 is defined substantially longitudinally with respect to the body 10 intermediate the tip 18 thereof and the slots 24, 26, 28 and 30 used for the mounting of the first binding 14. The grooves 82 and 84 are slightly tapered near forward ends 86 and 88 thereof. Rearward ends 90 and 92 of respective grooves 82 and 84 are substantially defined parallel to the respective slots 26 and 30 in order not to weaken the body 10 of the snow board S.

Figure 7:
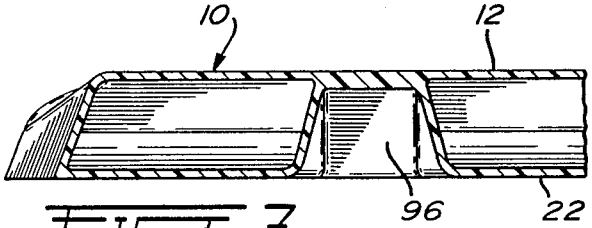
FIG. 7 is a cross-sectional elevation view taken along line 7—7 of FIG. 3 illustrating an elongated groove defined on the lower surface of the snow board.
Figure 2:
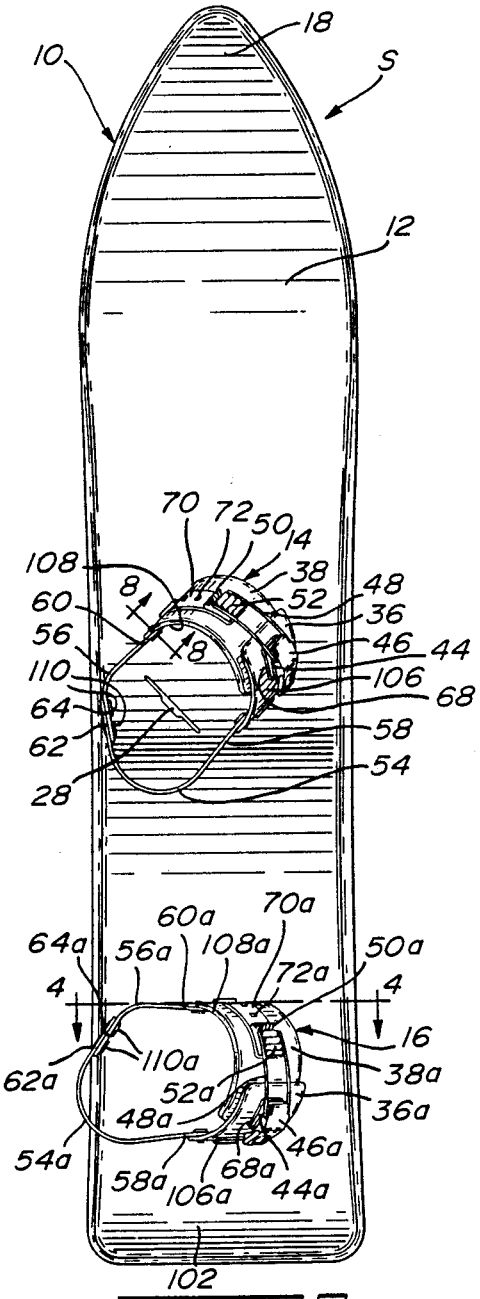
FIG. 2 is a top plan view of the snow board.

A second pair of grooves 94 and 96 is longitudinally defined in the bottom wall 22 of the body 10 intermediate the first and second bindings 14 and 16. These grooves are slightly tapered at both ends thereof as shown in FIG. 7.

Areas of the blow-molded body 10 bearing the weight of each foot of the rider are reinforced by way of the slots 24, 26, 28, 30, 32 and 34.

Furthermore, a pair of circular recesses 98 and 100 is provided in the bottom wall 22 of the body 10 substantially intermediate the slots 32 and 34 for the second binding 16. The circular recesses 98 and 100 tapered from the bottom wall 22 of the body towards the top wall 12 thereof, are aimed at reinforcing a rear end part 102 of the body 10 of the snow board S on which the weight of the rearward foot of the rider substantially lies.

The snow board S is therefore characterized by being of blow-molded construction and by comprising a pair of substantially fixed bindings 14 and 16 with respect to the body 10 thereof. Grooves and recesses 82, 84, 94, 96, 98 and 100 are provided in the bottom wall 22 of the body 10 for the reinforcement thereof. The configuration of the slots 24, 26, 28 and 30 allows for the first binding 14 to be mounted to the body 10 either for a front left foot or for a front right foot. The slots 32 and 34 can also accommodate the second binding 16 for allowing a rear left foot or a rear right foot.

The bindings 14 and 16 are designed for accommodating substantially any kind of footwear and, more particularly, any winter footwear, which, thus, results in a low cost snow board S.

I claim:

1. A board for snow skiing comprising an elongated ski body and at last one binding means mounted to said body for receiving a foot of a rider of said board, said binding means comprising a pair of flexible plastic bands mounted with first end parts thereof in spaced and substantially parallel slots defined through said board, said bands including second end parts provided with cooperating fastening means; said binding means also comprising a foot retaining means acting generally on a back part of said foot for further securing said foot to said board, each slot comprising an enlarged part defined in a bottom part of said board merging with a narrow part defined in a top part thereof, the first end part of each band being enlarged for fitting in said enlarged part of said slot with a remainder of said band being slidable through said narrow part of said slot, whereby said band is mounted to said board by passing said remainder of said band through said slot from said enlarged part through said narrow part thereof until said first end part of said band engages said enlarged part of said slot, whereat said first end part of the band is retained in said slot against upward and sideways movements thereof relative to said board, restraining means being provided to prevent said band from displacing downwards through said slot and thus said first end part of said band from releasing from said enlarged part of said slot.

2. A board as defined in claim 1, wherein said restraining means comprises at least one tapered protrusion provided on said remainder of said band and tapering away from said first end part of said band and adapted for allowing said band to move upwardly through said slot, said protrusion being positioned on said band in order that a highest end thereof abuts an upper surface of said top part of said board when said band is in a mounted position thereof on said board, whereby said band is downwardly restrained with respect to said upper surface of said board by said highest end.

3. A board as defined in claim 2, wherein a first and a second binding means are mounted to said board in a spaced apart relationship for respectively receiving a front and a rear foot of said rider.

4. A board as defined in claim 3, wherein said slot has a cross-sectional shape of an inverted "T" and wherein said slot is elongated, one elongated T-shaped slot being defined through said board for each of said bands of said binding means.

5. A board as defined in claim 4, wherein said foot retaining means comprises a strap means having each of two ends thereof attached to one of said bands for securing said back part of said foot to the binding means.

6. A board as defined in claim 4, wherein said elongated ski body is made of a blow-molded plastics material and wherein said body includes top and a bottom wall and reinforcing means extending between said top and bottom walls.

7. A board as defined in claim 5, wherein said band in said mounted position thereof is further downwardly restrained by said strap means being attached thereto while being in contact with said upper surface of said board.

8. A board as defined in claim 6, wherein said reinforcing means comprises at least a groove defined in the bottom wall of said board.

9. A board as defined in claim 6, wherein said reinforcing means comprises a pair of at least partly parallel elongated grooves defined substantially longitudinally in said bottom wall of said body, said pair of grooves being located intermediate a front end of said board and said first binding means.

10. A board as defined in claim 6, wherein said reinforcing means comprises a pair of parallel elongated grooves defined substantially longitudinally in said bottom wall of said body, said pair of grooves being located intermediate said first and second binding means.

11. A board as defined in claim 6, wherein said reinforcing means comprises a pair of circular recesses defined in said bottom wall of said body and tapering towards said top wall thereof, said recesses being substantially positioned for at least partly bearing weight communicated to the board by the rear foot of the rider.

12. A board as defined in claim 6, wherein said reinforcing means comprises a pair of circular recesses and first and second pairs of elongated grooves defined in said bottom wall of said body, said first pair of grooves being at least partly parallel and being located intermediate a front end of said board and said first binding means, said second pair of grooves being parallel and located intermediate said first and second binding means, said recesses tapering towards said top wall of said body and being positioned for at least partly bearing weight communicated to the board by the rear foot of the rider.

13. A board as defined in claim 7, wherein said fastening means comprises a buckle means and a catch means.

14. A board as defined in claim 13, wherein said buckle means is pivotally mounted to one of said bands, said catch means comprising a wire loop means for cooperating with a series of transverse recesses provided on the other of said bands for adjustability, whereby tightness of the foot is ensured in said binding means.

15. A board as defined in claim 14, wherein said strap means is provided with adjustment means for ensuring a fit thereof around said back part of the foot.

16. A board as defined in claim 4, or 6, wherein four elongated slots are associated with said first binding means, said four slots being defined diagonally on said board and facing each other in pairs for allowing mounting of said first binding means into one of two different positions for allowing one of a right foot and a left foot of the rider to be secured in said first binding means.

17. A board as defined in claim 4 or 6, wherein two elongated slots are associated with said second binding means, said two slots being defined transverse of said board for a transverse engagement of the rear foot of said rider therein with respect to said board and for allowing said rear foot to be one of a right and a left foot of said rider.

* * * * *